US011135115B2

(12) United States Patent
Long

(10) Patent No.: US 11,135,115 B2
(45) Date of Patent: Oct. 5, 2021

(54) BURIAL VAULT SYSTEM AND METHOD

(71) Applicant: David Long, Frankfort, IL (US)

(72) Inventor: David Long, Frankfort, IL (US)

(73) Assignee: Eagle Funeral Products Inc., Frankfort, IL (US)

( * ) Notice: Subject to any disclaimer, the term of this patent is extended or adjusted under 35 U.S.C. 154(b) by 0 days.

(21) Appl. No.: 16/534,587

(22) Filed: Aug. 7, 2019

(65) Prior Publication Data

US 2020/0069501 A1 Mar. 5, 2020

Related U.S. Application Data

(60) Provisional application No. 62/729,039, filed on Sep. 10, 2018, provisional application No. 62/717,046, filed on Aug. 10, 2018.

(51) Int. Cl.
*A61G 17/04* (2006.01)
*A61G 17/02* (2006.01)

(52) U.S. Cl.
CPC ..... *A61G 17/04* (2013.01); *A61G 17/02* (2013.01)

(58) Field of Classification Search
CPC ..... A61G 17/04; A61G 17/02; A61G 17/08; A61G 17/00; E04H 13/00; E04H 13/001; E04H 13/005; E04H 13/008
USPC ..... 27/11, 14, 35, 1; 52/128–133
See application file for complete search history.

(56) References Cited

U.S. PATENT DOCUMENTS 39,758 A * 9/1863 Skeele ..... A61G 17/048 27/11
994,299 A * 6/1911 Baughn ..... E04H 13/005 52/130
1,450,291 A * 4/1923 Heacock ..... E04H 13/00 27/17
2,000,919 A * 5/1935 Brunk ..... E04H 13/00 52/137
2,167,001 A * 7/1939 Oppenheim ..... A61G 17/00 27/32
2,655,714 A * 10/1953 Rench ..... A61G 17/00 27/35
3,435,494 A * 4/1969 Julien ..... A61G 17/048 27/11
3,940,894 A * 3/1976 Nunes ..... A61G 17/02 52/129
RE33,636 E * 7/1991 Yearsley ..... A61G 17/00 27/35
6,324,793 B1 * 12/2001 Klanke ..... E04H 13/00 27/1
2002/0050035 A1 * 5/2002 Spicer ..... E04H 13/00 27/35
2020/0069501 A1 * 3/2020 Long ..... A61G 17/02

* cited by examiner

*Primary Examiner* — William L Miller
(74) *Attorney, Agent, or Firm* — Harness, Dickey & Pierce, P.L.C.

(57) ABSTRACT

Disclosed is a system and method for accessing a burial vault after burying the burial vault to place remains of a second individual within the burial vault.

21 Claims, 4 Drawing Sheets

BURIAL VAULT SYSTEM AND METHOD

CROSS-REFERENCE TO RELATED APPLICATIONS

This application claims the benefit of both U.S. Provisional Application No. 62/717,046, filed on Aug. 10, 2018, entitled BURIAL VAULT SYSTEM AND METHOD and U.S. Provisional Application No. 62/729,039, filed on Sep. 10, 2018, entitled BURIAL VAULT SYSTEM AND METHOD. The entire disclosures of the above applications are incorporated herein by reference.

FIELD

The subject disclosure relates to burial systems, and particularly to a multiple burial system at a single location.

BACKGROUND

This section provides background information related to the present disclosure which is not necessarily prior art.

Often, when an individual is deceased, the individual may be buried in a casket and/or coffin that is placed in an outer burial container and/or burial vault. The burial vault may be formed of various materials, such as cast concrete. The cast concrete vault may be generally formed to fit around a casket to be placed in the vault. The vault is then sealed and placed in a prepared area under a surface of the ground. A lid of the burial vault may be placed on a base of the vault to seal the vault and the vault is covered with earth. Access to an interior of the vault, therefore, is generally impossible save for removing the earth and covering and removing the cast cement lid.

SUMMARY

This section provides a general summary of the disclosure, and is not a comprehensive disclosure of its full scope or all of its features.

Disclosed is a system that allows access to a selected portion of a burial vault for placing a selected item in the burial vault. In various embodiments, an access portal may be formed through the lid of a burial vault to allow access to at least a portion of an interior volume of the burial vault. The access portal may be accessed with a hole that has an area less than a whole area required to remove the vault lid, formed through the earth covering the burial vault. The access portal generally has a cross-section area less than that of the lid of the burial vault and/or a side of the burial vault.

The burial vault may include a formed or molded container with at least a lid portion of the burial vault. The portal through the lid of the burial vault may be opened to allow access to a container volume within the burial vault. The container volume may be defined by the vault lid alone and/or may be provided as a container that is molded into the burial vault.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
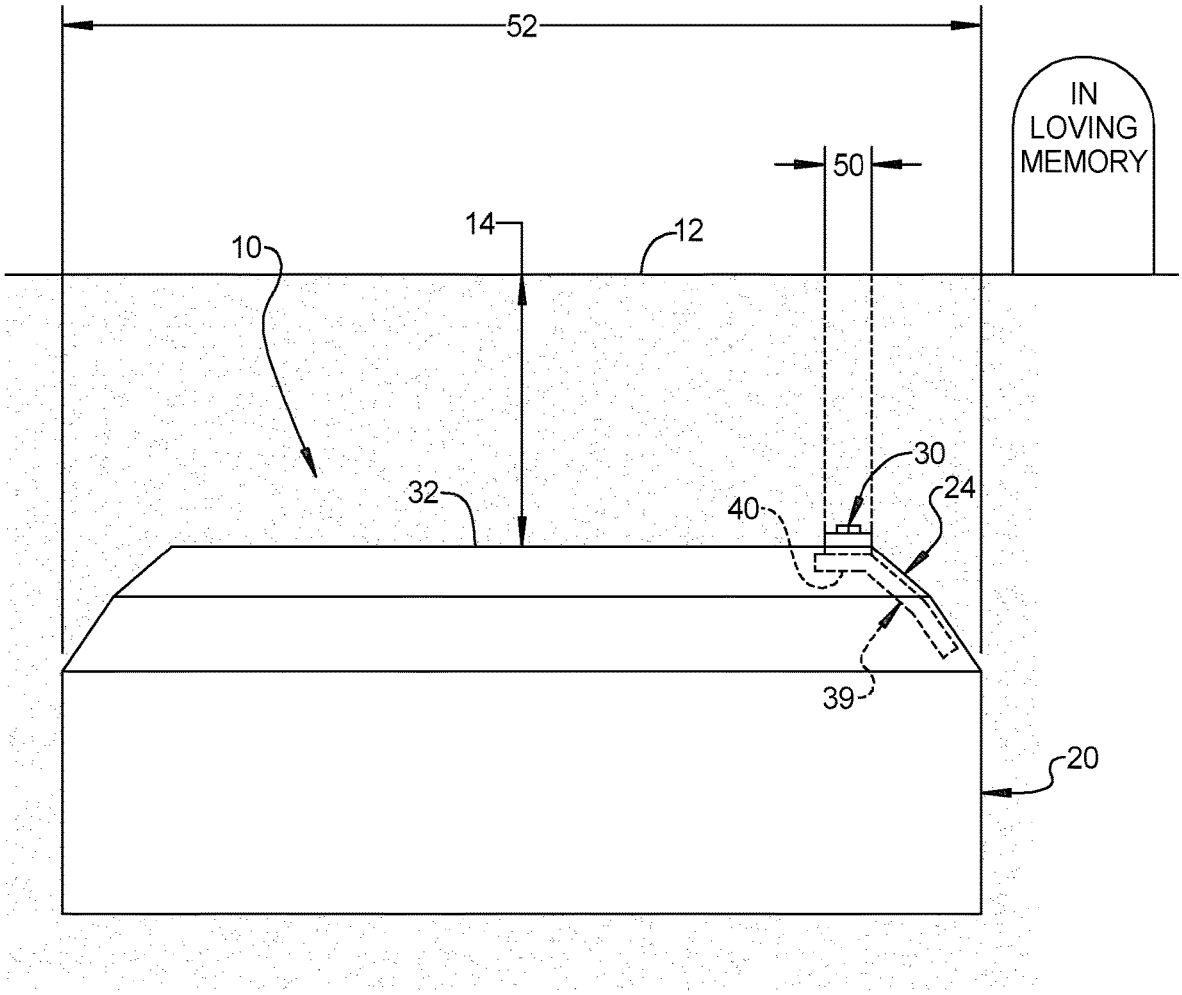
FIG. 1 is an environmental view of a burial vault under a surface of the earth.
Figure 2A:
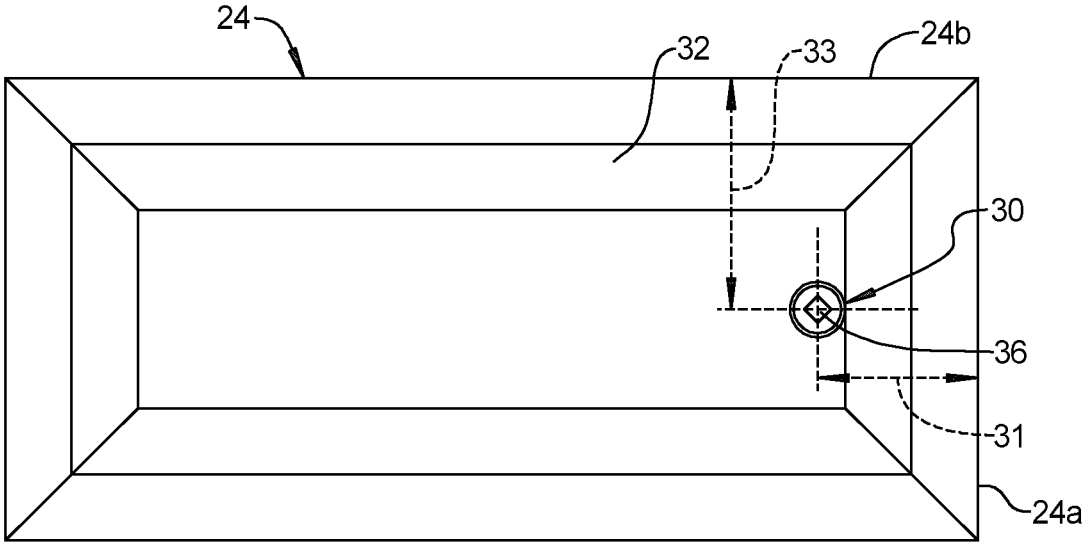
FIG. 2A is a bottom plan view of the top of the burial vault.
Figure 2B:
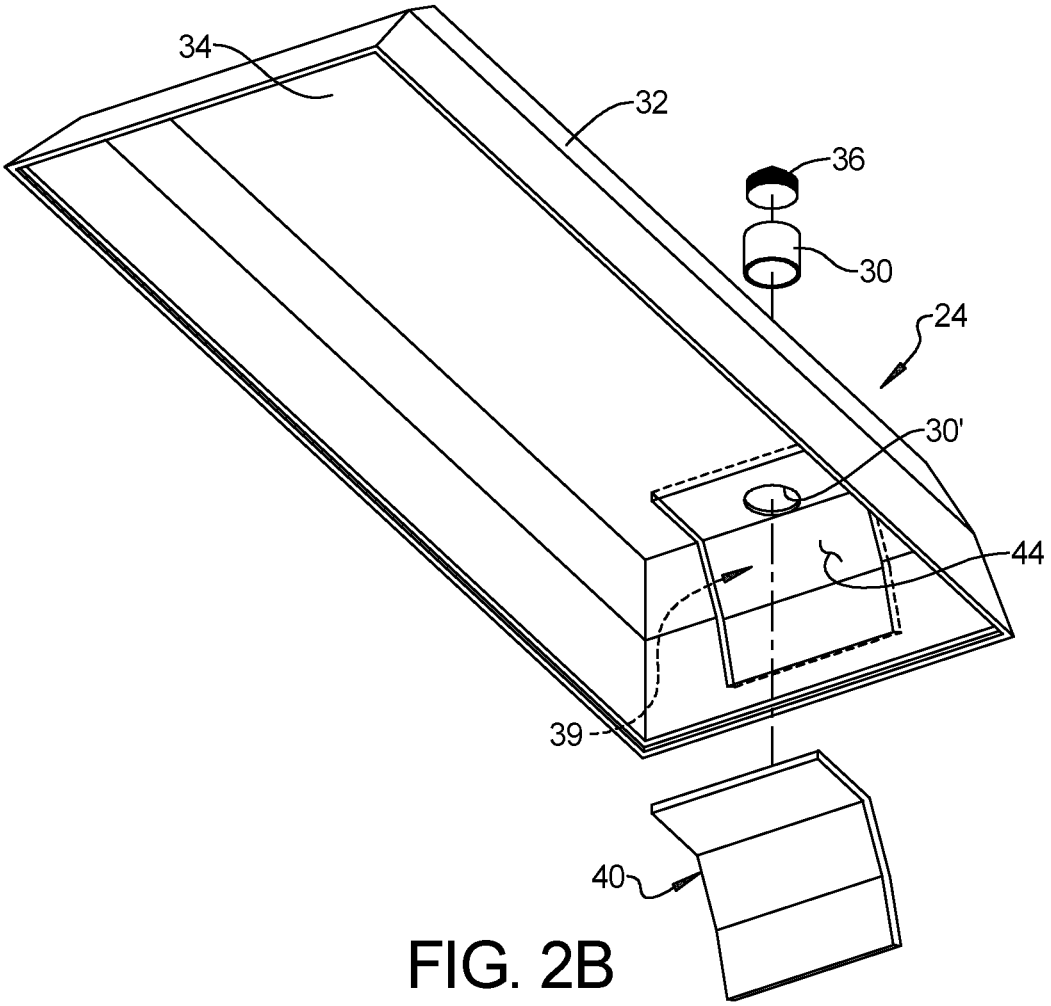
FIG. 2B is a top plan view of the top of the burial vault.
Figure 3:
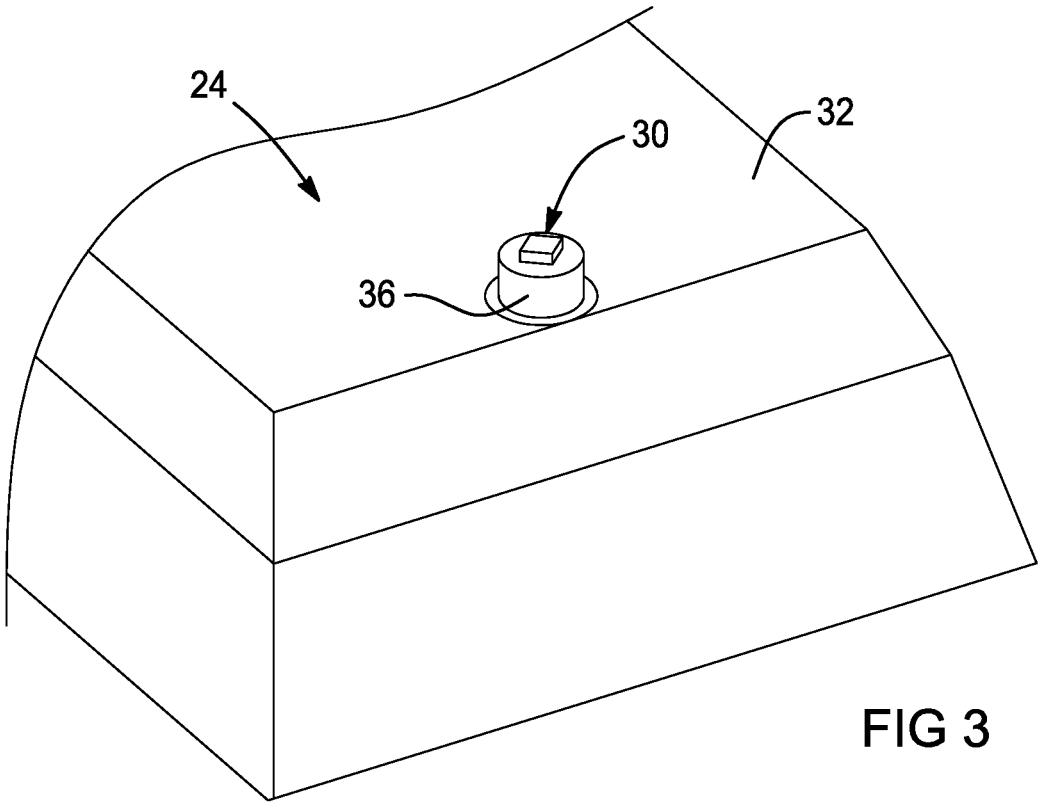
FIG. 3 is a picture including a perspective view of an end of the top of the burial vault with a portal having a cap thereon.
Figure 4:
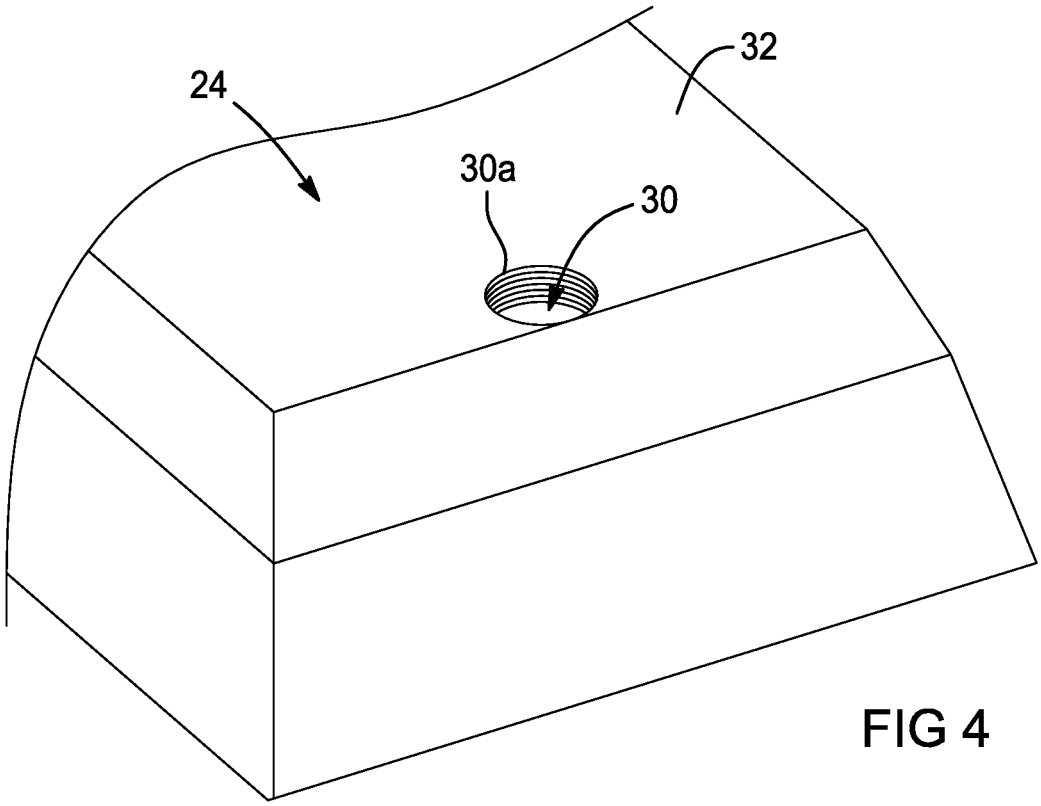
FIG. 4 is a picture including a detailed view of a top of a burial vault with a portal with a cap removed.

Example embodiments will now be described more fully with reference to the accompanying drawings.

With initial reference to FIG. 1 a burial vault or outer burial container 10 may be positioned below a surface 12 of the earth a selected distance 14. The distance 14 limits access or makes access to the burial vault 10 difficult after burying the burial vault 10. The burial vault 10 may include at least two portions.

The burial vault 10 may generally include a base 20, which may also be referenced to as a bottom or lower base portion. The base 20 may be initially placed in a hole formed below the surface 12. The base 20 may generally be hollow or open to receive a coffin. The base 20 may include or define an internal volume formed by walls that form the base 20. The internal volume formed by the base 20 may include any appropriate or selected volume. The base 20 may have one or more openings, or may have only one opening, to the internal volume.

At a selected time a coffin or casket, such as a coffin holding a deceased person, may be placed in the base 20 within the internal volume. The base 20, however, may generally fit tightly around the coffin to minimize volume or space taken by the burial vault 10 to bury an individual.

The burial vault 10 may further include a top 24 that may also be referred to as a lid or a cover. The top 24 may be substantially fitted to the base 20 and around the coffin to also minimize space of the burial vault 10. The top may have appropriate dimensions, such as including generally included dimensions of a lid height 24*h*, a lid length 241, and a lid width 24*w*. The top 24 may generally close or cover the opening, including the only opening, to the internal volume of the base. In various embodiments, once the top 24 is placed on the base 20 the burial vault 10 is substantially sealed to an environment around the burial vault 10.

The burial vault 10 may generally be formed of a selected material, such as cast concrete, iron, or other appropriate material that is generally a similar dense and heavy material. It is understood that the base 20 and the top 24 may be formed of the same or different materials. Further, the base 20 and the top 24 may both be formed separately as single pieces or members or formed of several pieces that are then integrated together. Accordingly, the weight or mass of the top 24 on the base 20 generally seals, at least for easy access of solid particles, the interior of the burial vault 10. Further, the distance 14 is generally covered with dirt to further limit access to the burial vault 10.

In various embodiments, however, an access portal 30 may be formed through the top 24. The top 24 may include an outer surface 32 and an inner surface 34. The access portal 30 may extend between the outer surface 32 and the inner surface 34 to allow access to an interior or at least the inner surface 34 of the top 24. The portal 30 may be a member or tube that is fit into an opening 30' in the top 24 of the vault 10. In various embodiments, however, a separate tube or member may not be provided and the opening 30' is the access portal 30.

With continuing reference to FIG. 1 and additional FIG. 2A, FIG. 2B FIG. 3, FIG. 4, FIG. 5, and FIG. 6, the top 24 of the burial vault 10 may have the portal 30 formed therein. The portal 30 may be any appropriate shape, and a round or cylindrical shape is merely exemplary. Further, the portal may include an appropriate size and dimension 30*d* such as about 2 inches (about 5 centimeters (cm)) to about 10 inches (about 26 cm), including about 4 inches (about 10 cm) to about 8 in (about 20 cm), including about 6 in (about 15 cm) in diameter. The dimensions of the portal 30 are generally smaller than the top 24. For example, a cross-sectional area of the portal 30 is less than an area of the opening of the base 20 covered by the top 24. The portal 30 may extend a selected distance above the outer surface 32 or may be formed substantially flush therewith. The portal 30 may be formed of a selected material, such as a selected polymer (e.g. polyvinyl chloride), metal or a metal alloy (e.g. stainless steel), or other appropriate material.

The portal 30 may also be placed at a known or standard position relative to the vault 10 or portion thereof, such as the top 24. For example, a center of the portal 30 may be a distance 31 from a foot or head end 24*a* of the vault 10 or the top 24. Also, the center of the portal 30 may be a distance 33 from a side 24*b* of the vault 10 of top 24. The distances 31, 33 may be predetermined and known and may place the center of the portal 30 in the middle of the top 24 and, for example, about 11 inches to about 20 inches (about 27 centimeters to about 50 centimeters) from the end 24*a*. Once the vault 10 is buried, therefore, a probe may be placed through the ground surface 12 to locate the side 24*b* and the end 24*b* to determine a location of excavation to reach the portal 30. Thus, excavating an area equal to that of the lid 24 may be avoided to access the container volume 39.

Figure 5:
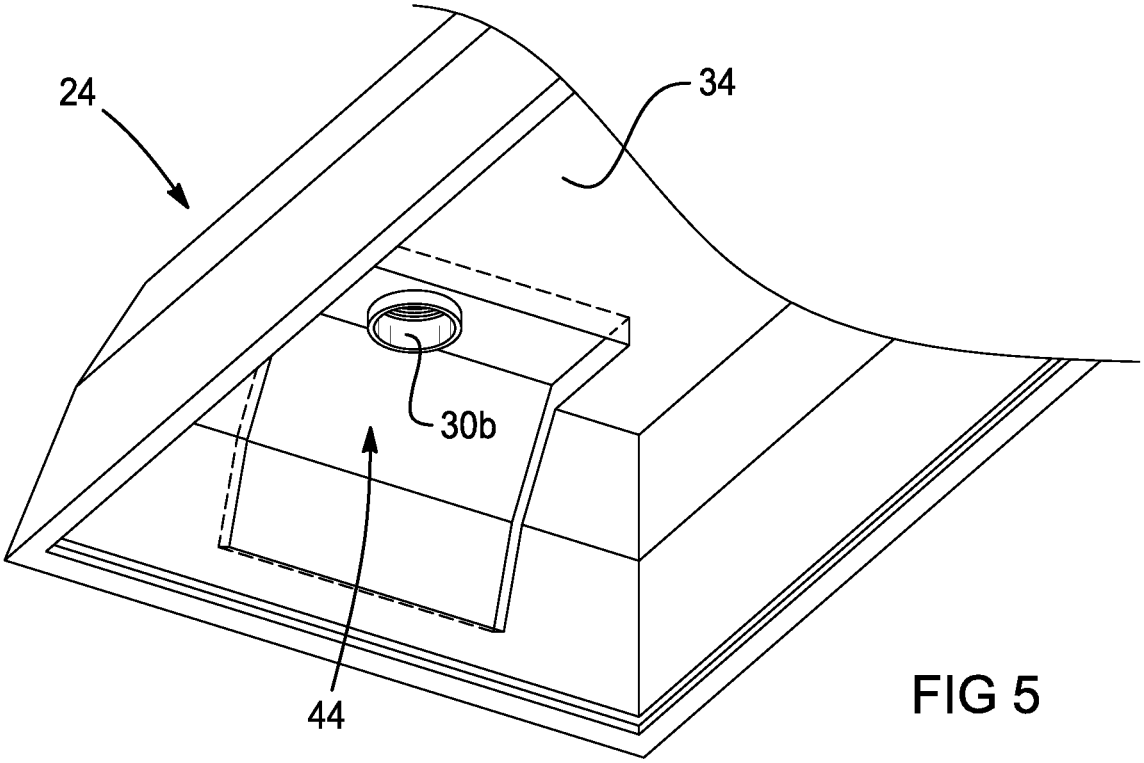
FIG. 5 is a picture including a detail interior view of a top of the burial vault.

The portal 30 may include a cap or covering 36. The cap or covering 36 may allow the portal 30 to be closed upon placement of the lid 24 on the base 20 and prior to accessing an internal or formed volume or volume container 40. As illustrated in FIG. 5, the portal 30 has a first portal end 30*a* at the exterior surface 32 and an internal end 30*b* at or near the internal surface 34 such as in a container volume 39. The container volume 39 may be defined or formed by a container 40 or a depression 44. The container 40 may be formed separately from the top 24 and positioned in the container volume 39. The cap 36 may also or alternatively engage the top 24 directly to seal the opening 30' when formed or provided as the portal.

Figure 6:
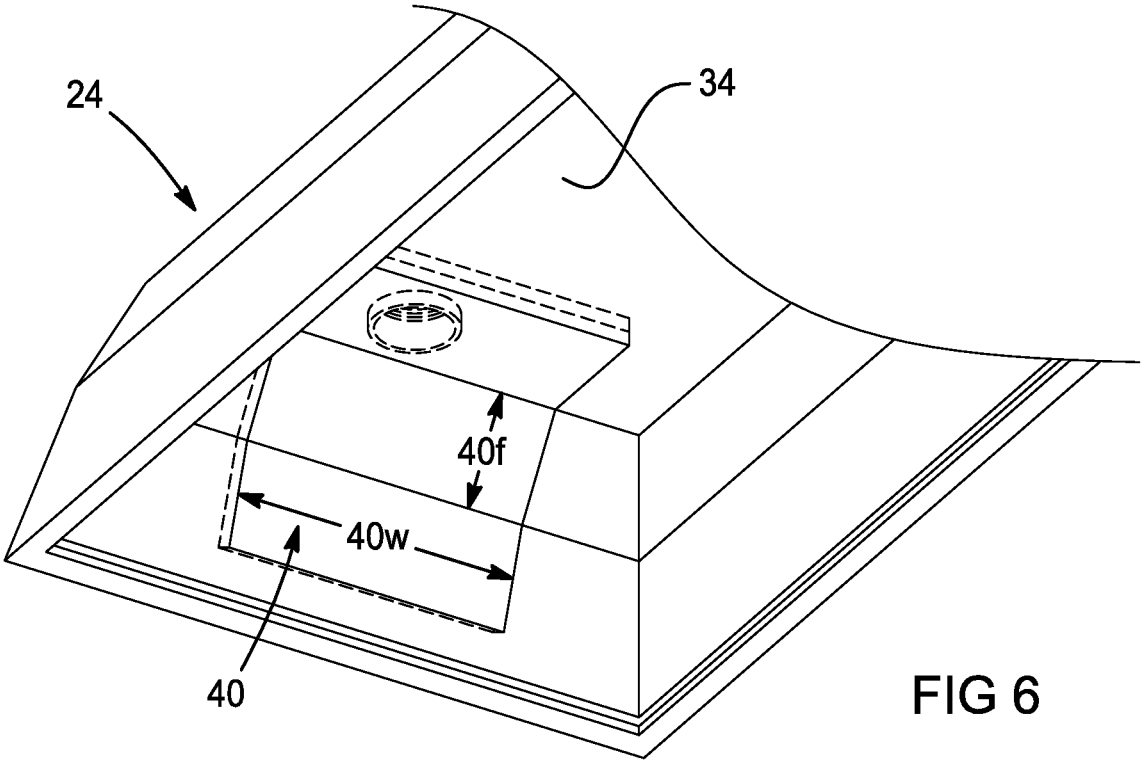
FIG. 6 is a picture including a picture of a detail view of an interior of the lid of the burial vault with a container cast therein.

The top 24 may define the container volume 34 such as by defining the depression 44 or having a depression formed therein. As illustrated in FIG. 6, the depression 44 may be filled with or have the container 40 positioned therein. The container 40 may be formed to fit the depression 44 and maintain an exterior geometry and dimension of the vault lid 24. The depression 44 and/or container 40 may generally be formed and/or placed within the general dimensions 241, 24*h*, 24*w* of the lid 24. Thus, the container volume 39 defined by the depression 44 or container 40 need not increase the size of the lid 24. It is understood, however, that the lid 24 may be formed to accommodate the container volume 39 by the depression 44 or the container 40, such as being formed with an appropriate dimensions. Further, it is understood that the container volume 39 may be placed in any appropriate location of the lid 24 and/or bottom 20. Further, although only one container volume 39 is illustrated, more than one may be formed in the lid 24 and/or bottom 20.

In various embodiments, one or both of the container 40 and the depression 44 may define the container volume. The container volume may be about 100 cubic inches (about 1.6 liters (L) to about 600 cubic inches (about 9.8 L), including about 200 cubic inches (about 3.2 L) to about 400 cubic inches (6.5 L), and further including about 200 cubic inches (about 3.2 l) to about 300 cubic inches (5 L). The container volume may be selected for various purposes, such as a general or average volume of ash of a human adult.

In various embodiments, the interior of the top 24 may include various facets. As illustrated in FIG. 5 and FIG. 6, the interior of the top 24 may include a first facet extending in generally parallel with a wall of the base 20, a second facet that extends at an angle relative with the first wall, and a top wall or surface that extends substantially perpendicular to the first wall. The container volume 39, such as the container 40, may include a width 40*w* of about 10 inches to about 20 inches, further including about 14 inches. Further, each portion of the container volume 39 within the respective facet may include a dimension 40*f* of about 3 inches to about 6 inches, and further including about 4 inches. It is understood, however, that the specific dimensions of the container volume 39 may vary based upon the selected material of the container 40, the overall size of the vault lid 24, the selected volume of the container volume 39, or other appropriate features.

It is also understood, however, that the vault lid 24 may have the depression 44 formed therein, such as with an investment cast portion or the like to allow the depression 44 to remain open when the vault lid 24 is placed on the vault base 20. For example, a material that may be melted or sublimated, such as polystyrene, wax, or the like, may be used to form the depression 44 during casting or molding of the vault lid 24. In various embodiments, vault 10, including the base 20 and the vault lid 24, is a cast cement product such that the depression 44 may be formed with an investment casting method.

The container 40 may be also molded into the vault lid 24 during a cast process without first having formed a depression in the lid 24. The container 40 may be a selected material, such as a blow or roto-molded polymer in a selected geometry and volume, such as that discussed above. The container 40 may further include internal bracing and/or external bracing to assist in maintaining the shape and internal volume of the container 40 during casting of the vault lid 24. The container 40 may be placed adjacent to the portal 30 and the vault lid 24 may be cast around the container 40. Thus, the container 40 may be placed and the lid 24 cast around the container 40 or the lid may be cast with a depression and the container 40 fit therein, such as with fasteners or adhesives. It is further understood that the lid 24 need not be formed with casting.

The portal 30 may be formed by a cast in place member, such as the member discussed above. In various embodiments, however, the portal may be formed by also an investment casting method where the portal 30 is formed through the lid 24 is formed or defined substantially only by the lid 24 after casting the vault lid 24. Thus, a pipe or tube may not be permanently placed or remain in place in the vault lid 24 after placement of the vault lid 24 relative to the base 20. The access portal 30 may also be formed by removing material from the top 24 once formed (e.g. drilling or hammering).

In various embodiments, use of the container volume 40 may be performed or used after placing the vault 10 in the burial site below the ground surface 12. For example, at a first time, such as an initial time, the vault 10 may be placed in the ground and a casket may be placed within the vault 10 in the internal volume of base 20 and the vault lid 24 is placed on the vault base 20. The dirt may then be placed over the vault 10 to the distance 14, as discussed above. The portal 30, however, remains through the vault lid 24 to access the volume container 40 within the vault lid 24. As discussed above, a selected cap or lid may be placed on the portal 30, as selected.

With reference to FIG. 1, after a period of time, such as after a deceasing of a second individual, and at a later time, access to the container volume 39 may be made through the portal 30. A relatively small opening or portal access hole 50, such as one having a dimension slightly greater than the portal 30, may be made through the ground surface 12 the distance 14 to the portal 30. The portal access hole 50 may be made with a selected tool such as an auger, small shovel, or the like. The portal access hole 50 allows access to the portal 30 without forming a hole 52 that is substantially equal in dimensions to the burial vault 10 and/or lid 24.

The portal 30 may then be accessed through the hole 50, such as by removing the cap 36, if present, and/or efficiently clearing the portal 30 of earthen material. The cap 36 may be fit to the portal 30 in any appropriate manner, such as with a snap fit, a threaded twist fit, or the like. Further, the cap 36 may be formed of an easily removable material such as a soft wax, or the like, that may be melted or removed with hot water or other warm material.

After access to the portal 30 is obtained, such as by removing the cap 36, if present, through the portal access hole 50, the remains of a second individual may be placed in the container volume 39. The remains of a second individual may be placed in the container volume 39 through the portal 30 through only or substantially only the access hole 50. Thus, two individuals may be placed within the single burial vault 10 at two different times without unearthing the burial vault 10, such as with a burial vault hole 52, at a second or later time. Accordingly, two individuals may be placed in the same burial plot, and even within the same burial vault 10, such as by placing an ashen remain through the portal 30 into the volume container 40.

One skilled in the art will understand that the container volume 39 may be placed in any appropriate portion of the burial vault 10. The lid 24 including the container volume 39 is merely exemplary. The container volume 39 may be formed or placed in the base 20, a side wall of the lid 24, or other appropriate location.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A burial container comprising:

a base having walls forming an internal volume, wherein the walls form at least one opening into the internal volume of the base;

a lid configured to cover the at least one opening;

a container within a container volume formed within the lid; and an access portal through an exterior surface of the lid to the container volume.

2. The burial container of claim 1, wherein the base is formed of cement cast to form the walls.

3. The burial container of claim 1, wherein the at least one opening is the only opening.

4. The burial container of claim 1, further comprising:

an access tube extending from the exterior surface of the lid to the container volume.

5. The burial container of claim 1, wherein the lid includes an internal surface having a depression formed therein that defines the container volume;

wherein the container is placed in the depression.

6. The burial container of claim 5, wherein the access portal is operable to allow access to the container.

7. The burial container of claim 1, further comprising:

a removable cover to close the access portal.

8. The burial container of claim 1, having a plurality of the container volume.

9. The burial container of claim 8, having a plurality of the access portal;

wherein each of the container volume of the plurality of container volumes is accessible by at least one access portal of the plurality of the access portals.

10. A burial container comprising:

a base having external walls forming an internal volume configured to receive a member, wherein the walls form at least one opening into the internal volume of the base to allow passage of the member into the internal volume;

a lid configured to close the at least one opening, wherein the lid has an external surface and an internal surface;

a container volume formed within the lid at least as a depression from at least a first portion of the internal surface and at least a second portion of the external surface and;

an access portal through the external surface of the lid to the container volume.

11. The burial container of claim 10, further comprising:

a container configured to be placed in the container volume.

12. The burial container of claim 11, wherein the access portal extends from the external surface to the container.

13. The burial container of claim 10, further comprising:

a removable cover to close the access portal.

14. The burial container of claim 10, further comprising:

an access tube extending from the external surface to the container volume.

15. The burial container of claim 10, wherein the lid is cast;

wherein the container volume is formed by investment casting.

16. A method to allow placement of remains of two individuals in a single burial vault, comprising:

providing the single burial vault to be placed below a ground surface with a first individual remains within the burial vault at a first time and to be covered with a material a distance below a ground surface;

forming an internal container volume in a lid of the single burial vault including placing a container within the lid; and forming an access portal in the single burial vault allowing accessing the internal container volume within the burial vault through the access portal.

17. The method of claim 16, further comprising:

configuring the access portal for placing remains of a second individual through only an access hole and through the access portal into the internal container volume formed within the burial vault;

wherein the access hole has an area less than a burial vault area.

18. The method of claim 17, further comprising:

providing the single burial vault to include a base.

19. The method of claim 18, wherein forming the internal container volume in the lid includes forming the internal container volume only within the lid.

20. The method of claim 16, wherein forming the internal container volume in the lid includes investment casting a depression from an internal surface of the lid.

21. A method to allow placement of remains of two individuals in a single burial vault, comprising:

providing the single burial vault to be placed below a ground surface with a first individual remains within the burial vault at a first time and to be covered with a material a distance below a ground surface;

providing an internal container volume in a lid of the single burial vault; and providing an access portal in the single burial vault allowing accessing the internal container volume within the burial vault through the access portal;

wherein providing the internal container volume in the lid includes a depression extending from an internal surface towards an external surface of the lid.

* * * * *